US009144987B2

(12) United States Patent
Ichikawa et al.

(10) Patent No.: US 9,144,987 B2
(45) Date of Patent: Sep. 29, 2015

(54) LIQUID FLOW-PATH MEMBER, LIQUID EJECTING HEAD, AND LIQUID EJECTING APPARATUS

(71) Applicant: SEIKO EPSON CORPORATION, Tokyo (JP)

(72) Inventors: Shinsuke Ichikawa, Tokyo (JP); Yuma Fukuzawa, Matsumoto (JP); Hitoshi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/618,676

(22) Filed: Feb. 10, 2015

(65) Prior Publication Data

US 2015/0224776 A1 Aug. 13, 2015

(30) Foreign Application Priority Data

Feb. 12, 2014 (JP) ..... 2014-024065

(51) Int. Cl.
*B41J 2/05* (2006.01)
*B41J 2/175* (2006.01)

(52) U.S. Cl.
CPC ..... *B41J 2/175* (2013.01)

(58) Field of Classification Search
CPC ..... B41J 2/175; B41J 2/17561; B41J 2/1623; B41J 2/14314; B41J 2002/14411; B41J 2002/14241
USPC ..... 347/65, 66, 67
See application file for complete search history.

(56) References Cited

U.S. PATENT DOCUMENTS

| | | | | |
|---|---|---|---|---|
| 6,257,703 | B1 * | 7/2001 | Hirosawa et al. | 347/50 |
| 6,945,627 | B2 * | 9/2005 | Yamaguchi | 347/27 |
| 8,262,199 | B2 * | 9/2012 | Takahashi | 347/45 |
| 8,403,441 | B2 * | 3/2013 | Tsubota et al. | 347/11 |

FOREIGN PATENT DOCUMENTS

JP 2009-165932 7/2009

* cited by examiner

*Primary Examiner* — Anh T. N. Vo
(74) *Attorney, Agent, or Firm* — Workman Nydegger

(57) ABSTRACT

A plurality of pressure chamber space sections are formed at an interval therebetween on a pressure chamber substrate. The shortest distance between an opening edge of one pressure chamber space section and an opening edge of the other pressure chamber space section of adjacent pressure chamber space sections in a joining surface of a pressure chamber substrate to a communication substrate is 50 μm or more. A recess section is formed to be separated from an ink flow path in a region interposed between these opening edges. At least one of the shortest distance between the opening edge of one pressure chamber space section and the recess section and the shortest distance between the opening edge of the other pressure chamber space section and the recess section is 30 μm or less.

12 Claims, 5 Drawing Sheets

LIQUID FLOW-PATH MEMBER, LIQUID EJECTING HEAD, AND LIQUID EJECTING APPARATUS

BACKGROUND

1. Technical Field

The present invention relates to a liquid flow-path member that forms a liquid flow path of a liquid ejecting head such as an ink jet-type recording head, a liquid ejecting head that includes the liquid flow-path member, and a liquid ejecting apparatus that includes the liquid ejecting head, and particularly to the liquid flow-path member, the liquid ejecting head, and the liquid ejecting apparatus in which substrates that configure the liquid flow-path member are joined to each other by an adhesive.

2. Related Art

A liquid ejecting apparatus includes a liquid ejecting head and ejects various liquids from the ejecting head. An example of the liquid ejecting apparatus includes an image recording apparatus such as an ink jet-type printer or an ink jet-type plotter. Recently, the liquid ejecting apparatus is also applied to various manufacturing apparatuses due to its characteristics of being capable of causing a very small amount of liquid to land at a predetermined position with accuracy. For example, the liquid ejecting apparatus is applied to a display manufacturing apparatus that manufactures a color filter such as a liquid crystal display, an electrode producing apparatus that produces an electrode, such as an organic electro luminescence (EL) display or a field emission display (FED), and a chip manufacturing apparatus that manufactures a bio chip (biochemical component).

The liquid ejecting head as described above may include a flow path of a liquid that is configured to have a plurality of plate-like structural members (substrates) which are joined to each other in a stacked state. Since the liquid flow path has been formed as an extremely fine structure in accordance with a recent trend toward miniaturization of the liquid ejecting head, a silicon substrate (silicon single crystal substrate) that has crystallinity is preferably used as the structural member of the liquid flow path and thus the liquid flow path is formed with high accuracy by anisotropic etching of the substrates (for example, JP-A-2009-165932). In addition, the substrates are joined to each other by using an adhesive. At this time, when the thickness of the adhesive is formed to be great, there is a concern that the adhesive leaks into the liquid flow path side when the substrates are joined to each other. The leaked adhesive spreads along a corner or the like of the flow path and then is attached to a driving portion for performing ejection of a liquid, or the like, which adversely affects the ejection of the liquid in some cases. Therefore, it is desirable that the thickness of the adhesive be formed to be as small as possible and, for example, be 10 μm or less. This is why application of the adhesive on a joining surface of the substrate is performed by transferring (for example, see JP-A-2009-165932). Specifically, the adhesive is applied on a transferring film on a squeegee stand in a uniform thickness by using a squeegee and then the adhesive layer applied on the film is transferred to the joining surface of the substrate. Thus, it is possible to adjust the thickness of the adhesive layer on the substrate to be small. As the adhesive, for example, an epoxy adhesive, a silicon adhesive, or a urethane adhesive is used.

Incidentally, in a method using the above transferring, after a transferring film 56 on which an adhesive 55 is applied is temporarily pasted to a substrate 57 as illustrated in FIG. 7A, the transferring film 56 is detached from the substrate 57 and thereby the adhesive 55 is transferred to the substrate 57 as illustrated in FIG. 7B. Then, as illustrated in FIG. 7C, ridge portions 55*a* where the adhesive 55 is applied to be relatively thick and trough portions 55*b* where the adhesive 55 is applied to be relatively thin are formed to be alternately repeated and a phenomenon in which the thickness of the adhesive 55 is non-uniform (hereinafter, also referred to as a waviness phenomenon of the adhesive) occurs. Composition or viscosity of the adhesive 55 affects a degree of thickness differences between or repetition of the ridge portions 55*a* and the trough portions 55*b* and the waviness phenomenon may occur in any case of using the various methods of bonding described above. The exact reason of the occurrence of the waviness phenomenon is unknown, but a bonding area is likely to be relatively wide in a configuration in which a very thin adhesive is transferred to the substrate using the transferring film 56. In a case where the substrates are joined to each other in a state in which the thickness of the transferred adhesive 55 is non-uniform due to the waviness phenomenon, a joining force is insufficient at the trough portions 55*b* and thus joining failure occurs. As a result, a problem arises in that ink leaks between liquid flow paths in the liquid ejecting head which includes a plurality of liquid flow paths.

SUMMARY

An advantage of some aspects of the invention is to provide a liquid flow-path member, a liquid ejecting head, and a liquid ejecting apparatus in which it is possible to suppress leaking of an adhesive to a liquid flow path side and to suppress leaking of a liquid between liquid flow paths.

According to an aspect of the invention, there is provided a liquid flow-path member that causes at least a part of a liquid flow path of a liquid ejecting head to be partitioned by joining substrates to each other by using an adhesive, a first flow path section and a second flow path section, each of which is a part of the liquid flow path, are formed at an interval therebetween on at least one of the substrates, the shortest distance between an opening edge of the first flow path section and an opening edge of the second flow path section in a joining surface of the one substrate is 50 μm or more, a recess section is formed to be separated from the liquid flow path in a region interposed between the opening edge of the first flow path section and the opening edge of the second flow path section in the joining surface, and at least one of the shortest distance between the opening edge of the first flow path section and the recess section and the shortest distance between the opening edge of the second flow path section and the recess section is 30 μm or less.

In this case, the recess section is formed in the inter-flow path opening region in the joining surface of one substrate and at least one of the shortest distance between the opening edge of one flow path section and the recess section and the shortest distance between the opening edge of the other flow path section and the recess section is set to be 30 μm or less. Accordingly, in a configuration in which application of an adhesive on the joining surface of the substrate is performed by transferring, an occurrence of a waviness phenomenon of the adhesive is decreased, thus it is possible to cause a thickness of an adhesive layer to be formed to be relatively small and uniform, and it is possible to suppress both leakage of the adhesive to the liquid flow path side and leakage of a liquid between the liquid flow paths.

In the liquid flow-path member, it is desirable that the shortest distance between the recess section and the opening edge of the first flow path section or between the recess section and the opening edge of the second flow path section or the shortest distance between the recess sections adjacent to each other be 22 μm or less.

In this case, the shortest distance between the recess section and the opening edge of one flow path section or between the recess section and the opening edge of the other flow path section is set to be 22 μm or less, and thereby it is possible to reliably suppress the leakage of the liquid between the liquid flow paths.

In the liquid flow-path member, it is desirable that a plurality of recess sections be formed at an interval therebetween in a region interposed between the opening edge of the first flow path section and the opening edge of the second flow path section in the joining surface, and the shortest distance between the opening edges of the recess sections adjacent to each other be 30 μm or less and desirably 22 μm or less.

In this case, since the occurrence of the waviness phenomenon of the adhesive in the region between the recess sections adjacent to each other is suppressed, it is possible to reliably suppress the leakage of the liquid between the liquid flow paths.

In the liquid flow-path member, it is desirable that the opening edge of the first flow path section be parallel to the opening edge of the second flow path section.

According to another aspect of the invention, there is provided a liquid ejecting head that includes the liquid flow-path member which has any configuration described above.

According to still another aspect of the invention, there is provided a liquid ejecting apparatus that includes the liquid ejecting head which has the configuration described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the invention are described with reference to the accompanying drawings. According to an embodiment which will be described later, various limitations thereto are provided as appropriate and specific examples of the invention; however, as long as there is no indication in the following description that the invention is particularly limited, the range of the invention is not limited to these aspects. In addition, hereinafter, an ink jet-type printer (hereinafter, printer), in which an ink jet-type recording head (hereinafter, recording head) is mounted, is described as an example of a liquid ejecting apparatus according to the invention.

Figure 1:
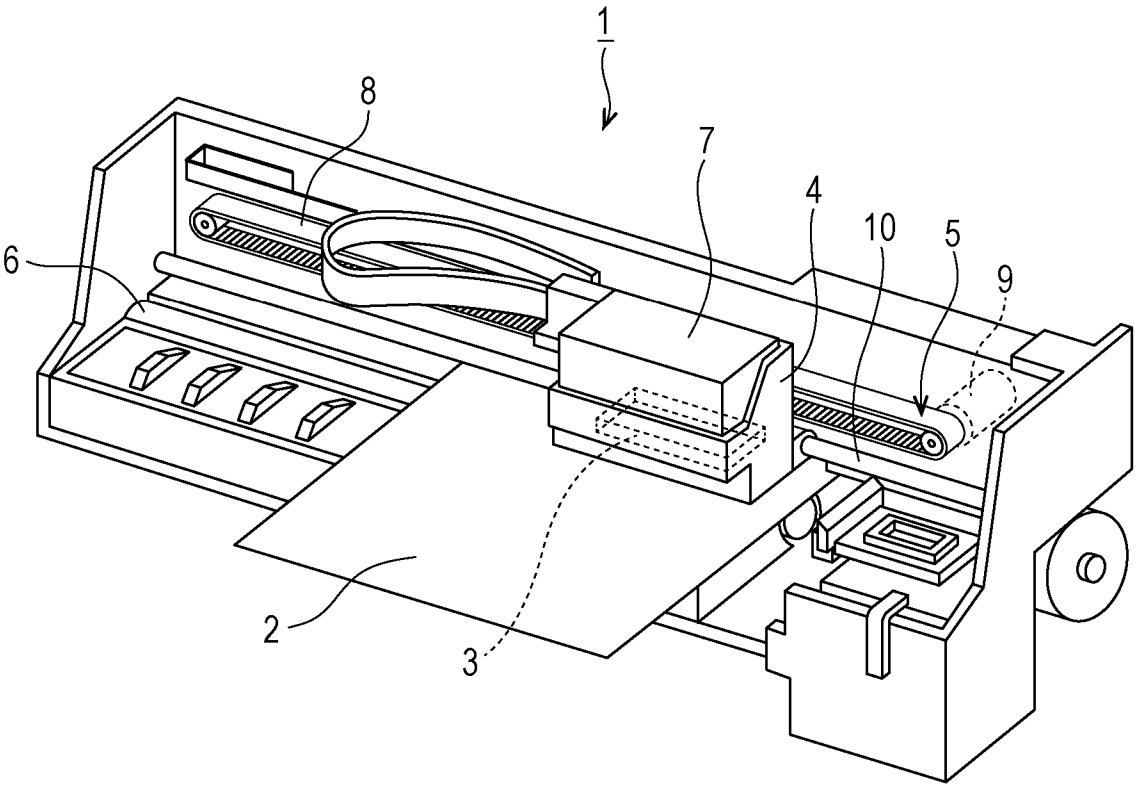
FIG. 1 is a perspective view illustrating a configuration of a printer.

A configuration of a printer 1 is described with reference to FIG. 1. The printer 1 is an apparatus that ejects ink onto a front surface of a recording medium 2 such as a recording sheet (a kind of landing target) and performs recording of an image or the like. The printer 1 includes a recording head 3 that ejects ink, a carriage 4 to which the recording head 3 is attached, a carriage moving mechanism 5 that moves the carriage 4 in the main scanning direction, and a platen roller 6 that transports the recording medium 2 in a sub scanning direction, or the like. Here, the ink is a kind of a liquid according to the invention and is stored in an ink cartridge 7 as the liquid supply source. The ink cartridge 7 is mounted detachably to the recording head 3. A configuration is employed, in which the ink cartridge 7 is disposed on a main body side of the printer 1 and the ink is supplied from the ink cartridge 7 through an ink supplying tube to the recording head 3.

The carriage moving mechanism 5 includes a timing belt 8. A pulse motor 9 such as a DC motor drives the timing belt 8. Then, when the pulse motor 9 operates, the carriage 4 is guided by a guide rod 10 that crosses over in the printer 1 and moves back and forth in a main scanning direction (width direction of the recording medium 2).

Figure 2:
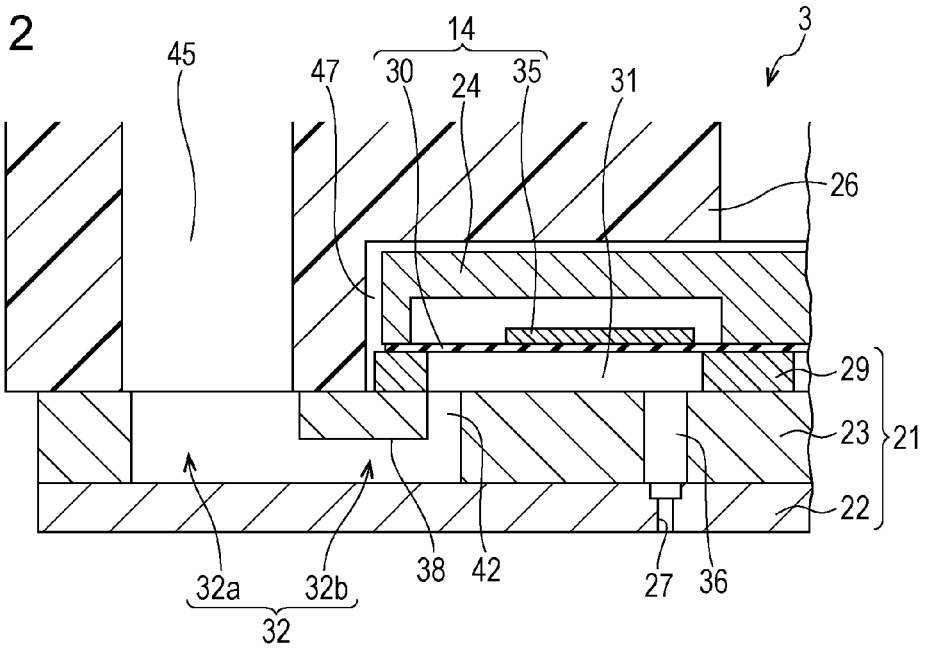
FIG. 2 is a cross-sectional view of main parts of a recording head.

FIG. 2 is a cross-sectional view illustrating an inner configuration of the recording head 3 (kinds of liquid ejecting head according to the invention). For convenience, a stacking direction of members is described as the vertical direction. The recording head 3 according to the present embodiment includes a pressure generating unit 14 and a flow path unit 21 (kinds of liquid flow-path members according to the invention) and is configured to be attached to a case 26 in a state in which the units are stacked. The flow path unit 21 includes a plurality of substrates that are specifically a nozzle plate 22, a communication substrate 23, and a pressure chamber formation substrate 29. In addition, an elastic film 30, a piezoelectric element 35 (kind of pressure generator), and a protecting substrate 24 are stacked to form a unit, which is the pressure generating unit 14.

The case 26 is a box-like member made of a synthetic resin, to which the flow path unit 21 is fixed on the underside thereof. A rectangular parallelepiped accommodation space 47 that is recessed from the underside to a mid position of the case 26 in its height direction is formed on the underside of the case 26 and the pressure generating unit 14 stacked on the flow path unit 21 is accommodated in the accommodation space 47. In addition, an ink introducing path 45 is formed in the case 26. In this configuration, ink from the ink cartridge 7 is introduced to a common liquid chamber 32 of the flow path unit 21 through the ink introducing path 45.

Figure 3:
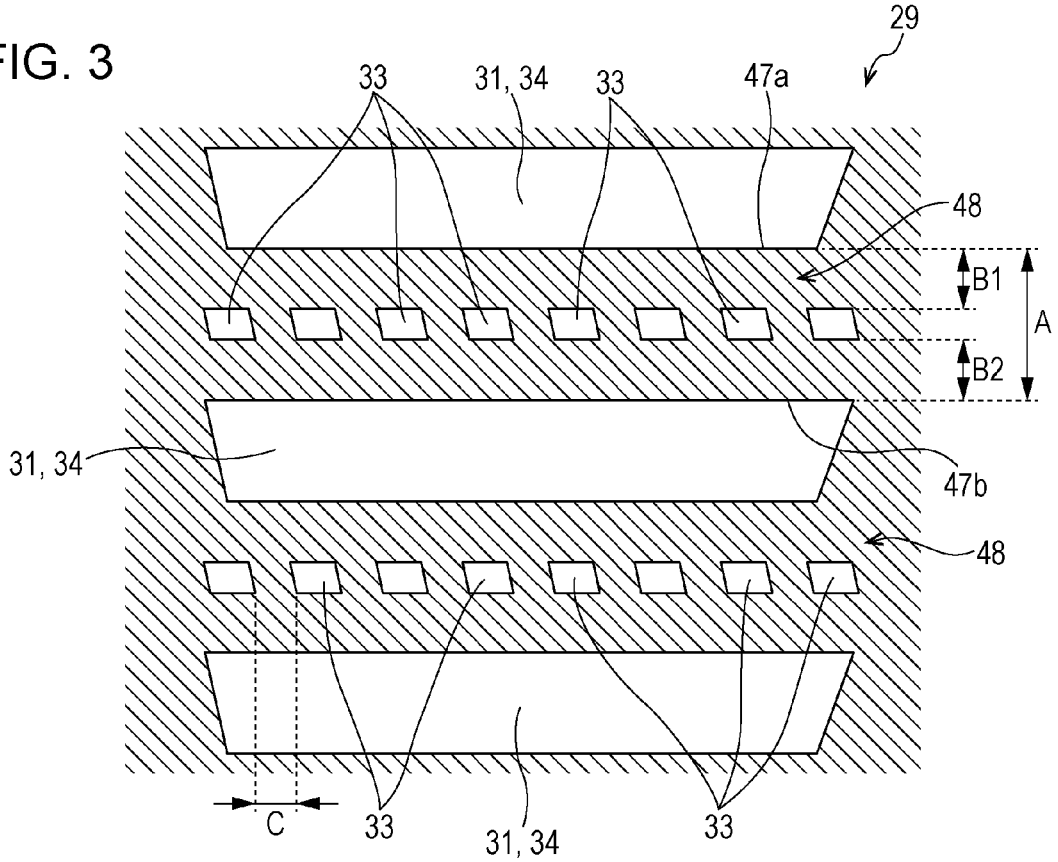
FIG. 3 is an enlarged view of main parts of a pressure chamber formation substrate.

FIG. 3 is an enlarged view of main parts of a joining surface of the pressure chamber formation substrate 29 to the communication substrate 23. The pressure chamber formation substrate 29 that is a structural member of the flow path unit 21 is manufactured by using a kind of silicon single crystal substrate (kind of crystalline substrate, hereinafter, also simply referred to as a silicon substrate). A plurality of pressure chamber spaces 34 that partition a pressure chamber 31 and are formed on the pressure chamber formation substrate 29 by an anisotropic etching process, corresponding to nozzles 27 of the nozzle plate 22, respectively. Thus, a portion of the flow path such as the pressure chamber is formed on the silicon substrate by the anisotropic etching and thereby it is possible to reliably achieve a more accurate size and shape. In addition, a plurality of recessed portions 33 (concave portions) are formed at an interval from each other on a region interposed between openings of the pressure chamber space 34 adjacent to each other in the joining surface of the pressure chamber formation substrate 29 to the communication substrate 23. The recessed portions 33 will be described later in detail.

One (top surface side) opening of the pressure chamber space 34 in the pressure chamber formation substrate 29 is sealed by the elastic film 30 of the pressure generating unit 14. In addition, the communication substrate 23 is joined to a surface of the pressure chamber formation substrate 29, which is opposite to the elastic film 30 and the other opening of the pressure chamber space 34 is sealed by the communication substrate 23. Thus, the pressure chamber 31 is formed to be partitioned. The pressure chamber 31 is a long space in a direction (second direction) orthogonal to a direction (first direction) along which the nozzles 27 are arranged in parallel. One end of the pressure chamber 31 in the second direction communicates with one nozzle 27 through a nozzle communicating path 36 in the communication substrate 23. In addition, the other end of the pressure chamber 31 in the second direction communicates with the common liquid chamber 32 through an individual communication port 42 of the communication substrate 23. The plurality of pressure chambers 31 are provided along a nozzle row direction (first direction) corresponding to the nozzles 27, respectively.

Similar to the pressure chamber formation substrate 29, the communication substrate 23 is a plate material manufactured from a silicon substrate. A space of the common liquid chamber 32 (reservoir) that is provided with respect to the plurality of pressure chambers 31 of the pressure chamber formation substrate 29 is formed in the communication substrate 23 by the anisotropic etching. The common liquid chamber 32 is a long space along a direction (that is, the first direction) along which the pressure chambers 31 are arranged in parallel. The common liquid chamber 32 according to the present embodiment is configured to include a first liquid chamber 32*a* that is provided to be through the communication substrate 23 in the plate thickness direction and a second liquid chamber 32*b* formed from the bottom side of the communication substrate 23 toward the top surface side to a mid position of the communication substrate 23 in the thickness direction in a state of leaving a thin section 38 on the top surface side. The thin section 38 configures the ceiling of the second liquid chamber 32*b*. One end (end apart from the nozzle 27) of the second liquid chamber 32*b* in the second direction communicates with the first liquid chamber 32*a* and the other end in the same direction is formed at a position corresponding to the underside of the pressure chamber 31. A plurality of individual communication ports 42 that is provided to be through the thin section 38 are formed at the other end of the second liquid chamber 32*b*, that is, at the edge opposite to the first liquid chamber 32*a* along the first direction such that the plurality of individual communication ports 42 correspond to the pressure chambers 31 of the pressure chamber formation substrate 29, respectively. The lower end of the individual communication port 42 communicates with the second liquid chamber 32*b* and the upper end of the individual communication port 42 communicates with the pressure chamber 31 of the pressure chamber formation substrate 29.

The nozzle plate 22 is a plate material on which the plurality of nozzles 27 are set in rows at a pitch corresponding to a dot formation density. According to the present embodiment, a nozzle row is configured to include 300 nozzles 27 which are set in rows at a pitch corresponding to 300 dpi. According to the present embodiment, two sets of nozzle rows are formed on the nozzle plate 22. The nozzle plate 22 according to the present embodiment is manufactured by using the silicon substrate. Dry etching is performed on the substrate such that cylindrical nozzles 27 are formed. An ink flow path from the common liquid chamber 32 through the individual communication port 42, the pressure chamber 31, and the nozzle communicating path 36, to the nozzle 27 corresponds to a liquid flow path according to the invention. In addition, the individual communication port 42, the pressure chamber 31, and the nozzle communicating path 36 which are provided for each nozzle 27 configure an individual flow path. The individual flow path is the liquid flow path in a narrow sense.

The elastic film 30 formed on the top surface of the pressure chamber formation substrate 29 is configured of, for example, silicon dioxide to have a thickness of about 1 μm. In addition, an insulation film (not illustrated) is formed on the elastic film 30. The insulation film is, for example, formed of zirconium oxide. The piezoelectric elements 35 are formed at positions on the elastic film 30 and the insulation film, which correspond to the pressure chambers 31, respectively. The piezoelectric element 35 is a so-called flexure mode piezoelectric element. The piezoelectric element 35 has a configuration in which a lower metal electrode film, a piezoelectric layer formed of lead zirconate titanate (PZT) or the like, and an upper metal electrode film (none of them illustrated) are laminated in this order on the elastic film 30 and the insulation film and then patterning is performed for each pressure chamber 31. One of the upper electrode film and the lower electrode film is used as a common electrode and the other one is used as an individual electrode. In addition, the elastic film 30, the insulation film, and the lower electrode film function as a vibrating plate during driving of the piezoelectric element 35. That is, the portion corresponds to a driving portion for performing liquid ejection.

The nozzle plate 22, the communication substrate 23, and the pressure chamber formation substrate 29 which configure the flow path unit 21 are joined to each other by an adhesive. Examples of the adhesive include an epoxy adhesive, a silicon adhesive, or a urethane adhesive. Here, as illustrated in FIG. 3, the shortest distance A (distance in a normal direction to the opening edge) between an opening edge 47*a* of one pressure chamber space 34 and an opening edge 47*b* of the other pressure chamber space 34, which are adjacent, in the joining surface of the pressure chamber formation substrate 29 to the communication substrate 23 is 50 μm or more. Accordingly, in the liquid ejecting head of the related art, in a case where a width of the region between the opening edges of the adjacent liquid flow paths is 50 μm or more, a waviness phenomenon is likely to occur, in which the thickness of an adhesive is non-uniform when the adhesive is transferred. Accordingly, there is a concern that leakage of a liquid between the liquid flow paths occurs. The flow path unit 21 according to the invention is configured to decrease an occurrence of adhesion failure in a configuration in which the adhesive is transferred to the substrates that configure the flow path unit 21 and thus to suppress leakage of ink, which will be described hereinafter.

In the flow path unit 21 according to the invention, the plurality of recessed portions 33 are formed at an interval from each other in a region (hereinafter, inter-flow path opening region 48) which is interposed between the opening edge 47*a* of one pressure chamber space 34 and the opening edge 47*b* of the other pressure chamber space 34 of the adjacent pressure chamber spaces 34, in the joining surface of the pressure chamber formation substrate 29 to the communication substrate 23, along the opening edges 47*a* and 47*b*. The recessed portion 33 is formed by the anisotropic etching similar to the pressure chamber space 34, and is formed from the joining surface to a mid position of the pressure chamber formation substrate 29 in the thickness direction such that the recessed portion 33 is a separated space from the ink flow path such as the pressure chamber 31. The thickness of the pressure chamber formation substrate 29 is 400 μm and the depth of the recessed portion 33 is, for example, 20 μm to 30 μm. At least one of the shortest distance B1 from the opening edge of the recessed portion 33 to the opening edge 47*a* of the one pressure chamber space 34 and the shortest distance B2 from the opening edge of the recessed portion 33 to the opening edge 47*b* of the other pressure chamber space 34 is set to be 30 μm or less, and desirably 22 μm or less (here, B1>0 and B2>0). In addition, the interval (interval between the opening edges of the recessed portions 33) C between the adjacent recessed portions 33 is set to be 30 μm or less, and desirably 22 μm or less (here, B1>0 and B2>0). According to the present embodiment, the one pressure chamber space 34 of the adjacent pressure chamber spaces 34 corresponds to the first flow path section according to the invention and the other pressure chamber space 34 corresponds to the second flow path section according to the invention. The pressure chamber formation substrate 29 according to the present embodiment corresponds to one substrate and the communication substrate 23 corresponds to the other substrate.

When the flow path unit 21 according to the present embodiment is manufactured, first, the elastic film 30 and the insulation film are formed in this order on the top surface of the pressure chamber formation substrate 29 (silicon substrate in a state in which the pressure chamber space 34 is not formed), and then the piezoelectric element 35 is formed by firing. In this state, the pressure chamber space 34 and the recessed portion 33 are formed from the underside of the pressure chamber formation substrate 29 (joining surface side to the communication substrate 23) by wet etching (anisotropic etching) using an etching solution consisting of, for example, a potassium hydroxide solution. Here, the pressure chamber space 34 is formed in a state of being through the pressure chamber formation substrate 29 and, when the recessed portion 33 is formed, a mask pattern or a processing time of the etching is adjusted such that the recessed portion 33 is formed to a mid position of the pressure chamber formation substrate 29 in the thickness direction. Similarly, the common liquid chamber 32, the individual communication port 42, the nozzle communicating path 36, and the like are formed in the communication substrate 23 by the wet etching. Meanwhile, the nozzles 27 are formed on the nozzle plate 22 by the dry etching.

After a portion of the ink flow path is formed in the substrates that configure the flow path unit 21, the substrates are joined to each other by the adhesive. Hereinafter, particularly, a process of joining the pressure chamber formation substrate 29 to the communication substrate 23 is described with reference to FIGS. 4A to 4D. FIGS. 4A to 4D are cross-sectional views schematically illustrating a configuration in the vicinity of the inter-flow path opening region 48 of the pressure chamber formation substrate 29.

Figure 4A:
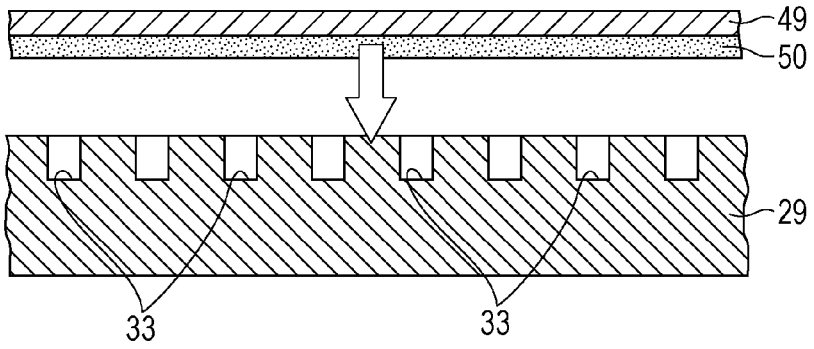
FIGS. 4A to 4D are views illustrating a flow path unit in a manufacturing process.
Figure 4B:
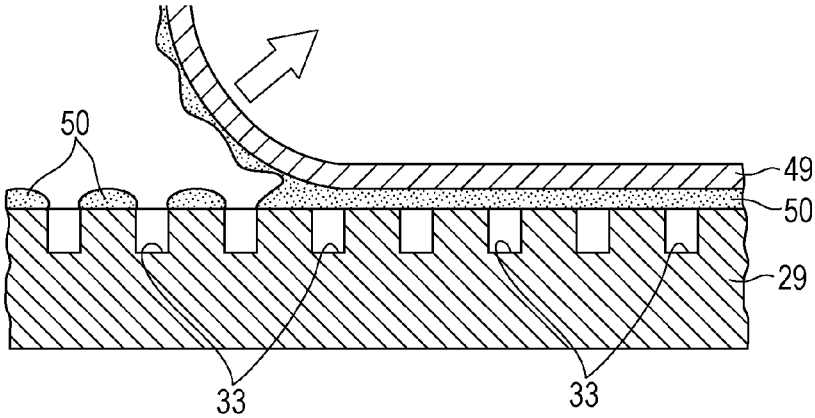
Figure 4C:
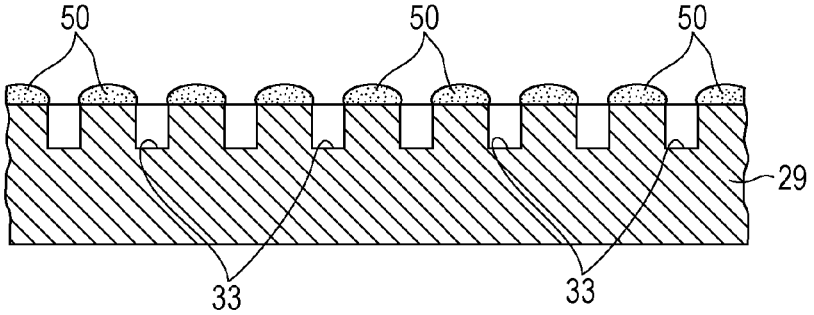
Figure 4D:
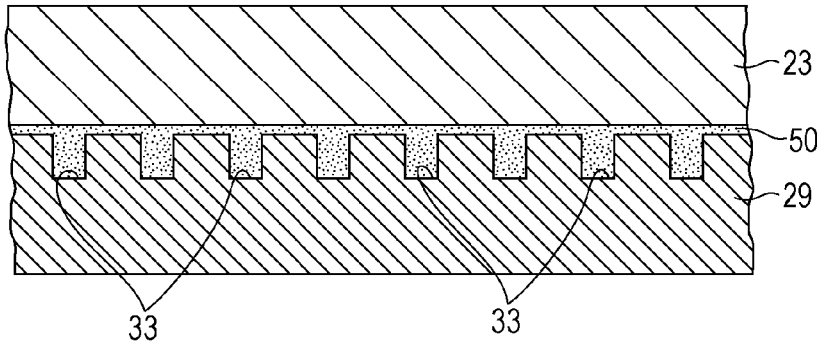

First, as illustrated in FIG. 4A, a transferring film 49, on which an adhesive 50 is applied by a squeegee in advance, is bonded while a predetermined pressure is applied to the joining surface of the pressure chamber formation substrate 29 to the communication substrate 23. It is possible to employ a known method in the related art as a method of transferring the adhesive. Then, as illustrated in FIG. 4B, the transferring film 49 is detached from the pressure chamber formation substrate 29 starting from one end to the other end of the pressure chamber formation substrate 29. Accordingly, as illustrated in FIG. 4C, the adhesive 50 is transferred to portions except the opening of the pressure chamber space 34 and the opening of the recessed portion 33 on the joining surface of the pressure chamber formation substrate 29. Here, the plurality of recessed portions 33 are formed in the inter-flow path opening region 48 on the joining surface of the pressure chamber formation substrate 29 to the communication substrate 23 and thus a region between the recessed portion 33 and the opening of the pressure chamber space 34 or between the recessed portions 33 has a narrow width of 30 μm or less. Accordingly, in this region, the occurrence of the waviness phenomenon of the adhesive is suppressed.

After the adhesive 50 is transferred to the pressure chamber formation substrate 29, the communication substrate 23 is joined to a surface on which the adhesive 50 is transferred. At this time, a part of the adhesive 50 between the pressure chamber formation substrate 29 and the communication substrate 23 flows into the recessed portions 33. When the adhesive 50 is cured, the adhesive 50 in the recessed portions 33 contributes to an anchoring effect and the pressure chamber formation substrate 29 and the communication substrate 23 are bonded and joined tightly. The thickness of the adhesive 50 becomes very small and uniform to be 10 μm or less except the portions in the recessed portions 33. In addition, when the substrates are pressed to each other during joining, an extra adhesive flows into the recessed portions 33. Therefore, leakage of the adhesive 50 to the ink flow path such as the pressure chamber 31 is suppressed. Similarly, the nozzle plate 22 is joined to a surface of the communication substrate 23 which is opposite to the pressure chamber formation substrate 29 by bonding. In this case, the adhesive is transferred to the joining surface of the communication substrate 23 to the nozzle plate 22 and both substrates are joined to each other. Accordingly, the flow path unit 21 is formed to be a single unit, inside which the ink flow path through the common liquid chamber 32, the individual communication port 42, the pressure chamber 31, and the nozzle communicating path 36 to the nozzle 27 is formed.

Thus, the recessed portions 33 are formed to be separate from the ink flow path, in the inter-flow path opening region 48 on the joining surface of the pressure chamber formation substrate 29 to the communication substrate 23 and at least one of the shortest distance between the opening edge (opening edge 47*a*) of one flow path section and the recessed portion 33 and the shortest distance between the opening edge (opening edge 47*b*) of the other flow path section and the recessed portion 33 is set to be 30 μm or less. Thus, in the configuration in which the application of the adhesive is performed to the joining surface of the substrates by the transferring, the occurrence of the waviness phenomenon of the adhesive is decreased and thus it is possible to form the thickness of the adhesive layer to be small and uniform. As a result, it is possible to suppress both the leakage of the adhesive to the ink flow path side and the leakage of the ink between the ink flow paths.

In an experiment, when a width of a portion in the inter-flow path opening region 48 on which the adhesive layer is formed was 30 μm or less, an effect of suppressing the leakage of the ink between the ink flow paths was achieved. When the width of the portion was 22 μm or less, a result was achieved that nearly no leakage occurred. Accordingly, the shortest distance between the opening edge of the one flow path section and the recessed portion 33 or the shortest distance between the opening edge of the other flow path section and the recessed portion 33 is set to be 22 μm or less, and thereby it is possible to more reliably suppress the leakage of the ink between the ink flow paths. Similarly, the shortest distance between the opening edges of the recessed portions 33 adjacent to each other is desirably 30 μm or less and more desirably 22 μm or less. Thus, since the occurrence of the waviness phenomenon of the adhesive is suppressed in the region between the recessed portions 33 adjacent to each other, it is possible to further reliably suppress the leakage of the ink between the ink flow paths.

Incidentally, the invention is not limited to the embodiments described above, and various modifications can be performed on the basis of the aspects of the invention.

For example, a configuration is exemplified, in which the recessed portions 33 are provided in the inter-flow path opening region 48 between the pressure chamber spaces 34 adjacent to each other in the pressure chamber formation substrate 29; however, the invention is not necessarily limited thereto. In short, the shortest distance between the opening edges of the liquid flow paths adjacent to each other on the joining surface of a substrate that configures a part of the liquid flow-path member to another substrate is 50 μm or more. Then, in a case where there is a problem of leakage of a liquid between the liquid flow paths, recessed portions are provided in a region interposed between both opening edges and thereby the same effect as in the embodiment described above is achieved.

Figure 5:
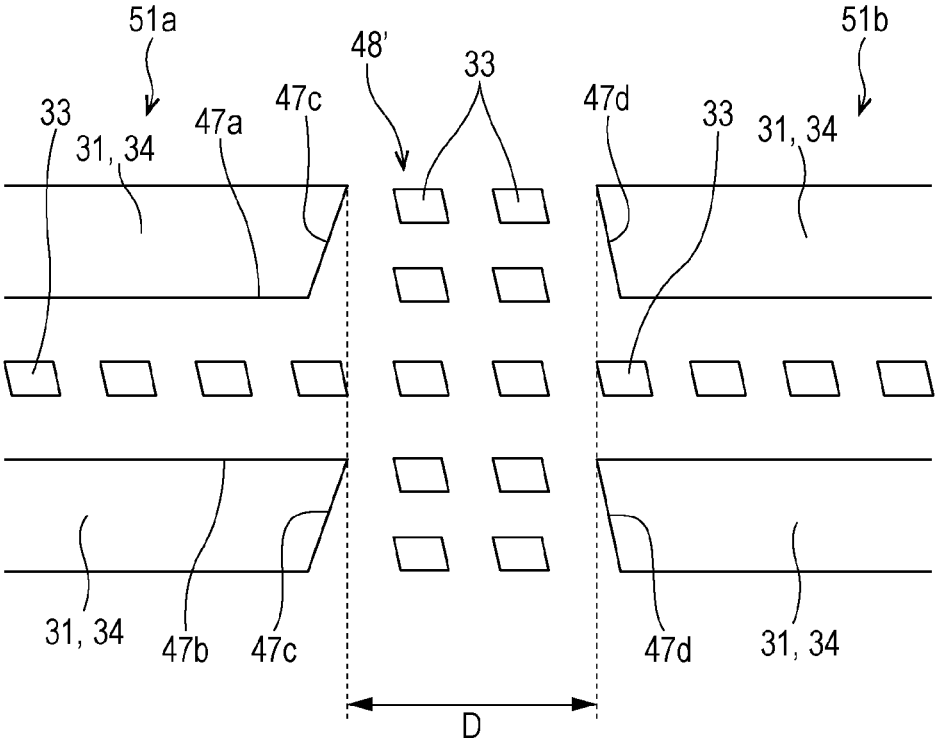
FIG. 5 is an enlarged view of main parts of a pressure chamber formation substrate illustrating a configuration of a modification example according to the invention.

In addition, as shown in a modification example illustrated in FIG. 5, the opening edges of the ink flow path sections may not necessarily be parallel to each other, but may be slightly inclined to each other. The modification example illustrated in FIG. 5 has a configuration in which a plurality of rows of pressure chambers 31 (pressure chamber spaces 34) are provided and there is a problem of leakage of ink even between these rows of pressure chambers. Pressure chamber rows 51*a* and 51*b* are configured to include the plurality of pressure chambers 31 provided in parallel along the vertical direction (first direction) in FIG. 5 and the pressure chamber rows 51*a* and 51*b* are provided in parallel to be separated by the shortest distance D from each other in the horizontal direction (second direction) in FIG. 5. In the configuration, opening edges 47*c* and 47*d* of the pressure chamber spaces 34 adjacent to each other on the right and left of FIG. 5 are inclined to each other. In this configuration, at least one of the shortest distance from the opening edge of the recessed portion 33 to the opening edge 47*c* of one pressure chamber space 34 and the shortest distance to the opening edge 47*d* of the other pressure chamber space 34 is set to be 30 μm or less and desirably 22 μm or less. In addition, an interval between the recessed portions 33 adjacent to each other is set to be 30 μm or less and desirably 22 μm or less. In this configuration, the one pressure chamber space 34 of the pressure chamber spaces 34 adjacent on the right and left in FIG. 5 corresponds to the first flow path section according to the invention and the other pressure chamber space 34 corresponds to the second flow path section according to the invention. It is possible to provide a plurality of rows of the recessed portions 33 depending on the shortest distance D of both the opening edges 47*c* and 47*d* (minimum width of an inter-flow path opening region 48'). Thus, it is possible to suppress leakage of ink between the pressure chamber rows 51*a* and 51*b*.

Figure 6:
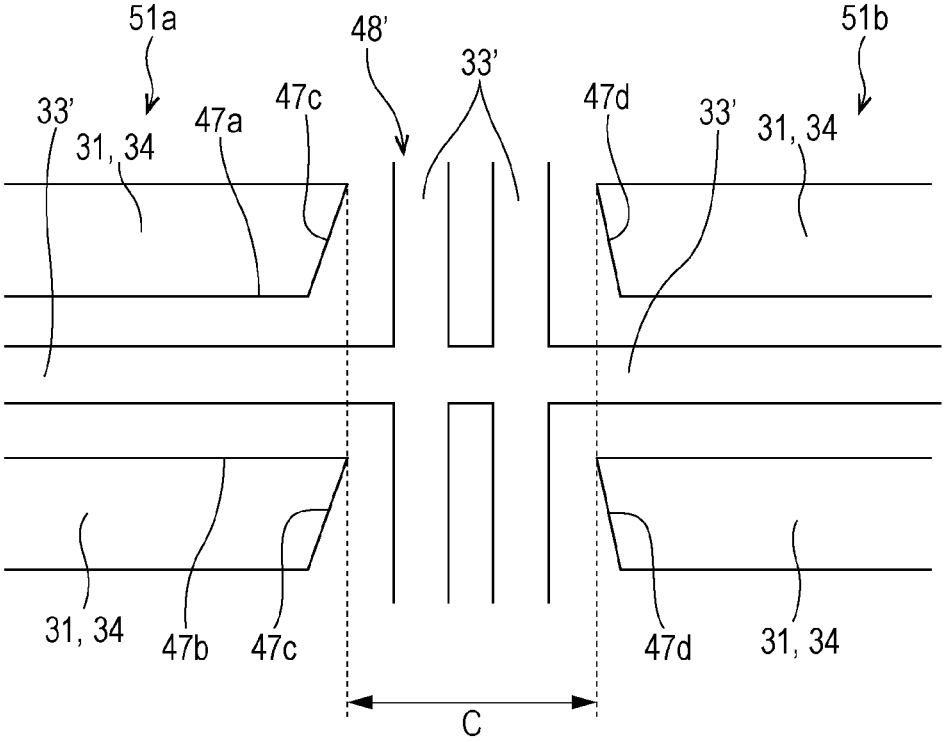
FIG. 6 is an enlarged view of main parts of a pressure chamber formation substrate illustrating a configuration of another modification example according to the invention.
Figure 7A:
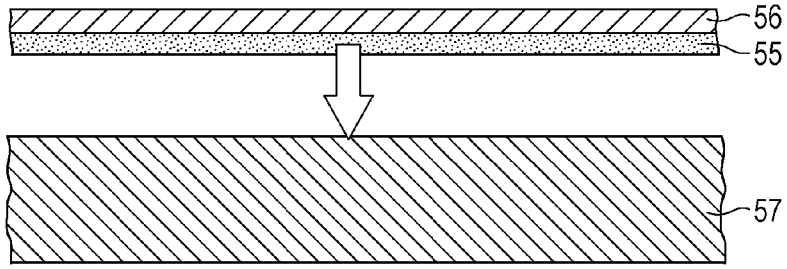
FIGS. 7A to 7C are views illustrating transferring of an adhesive in a configuration of the related art.
Figure 7B:
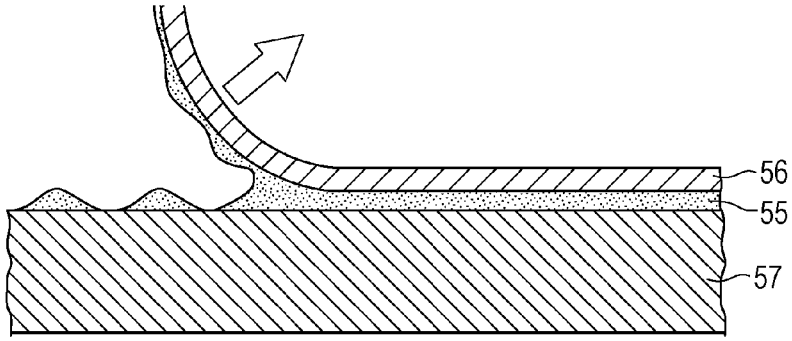
Figure 7C:
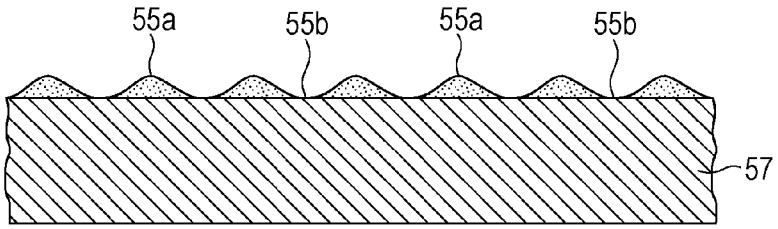

Further, although the recessed portion 33 which has a parallelogram opening is exemplified, the shape of the recessed portion 33 is not limited thereto. For example, as shown in another modification example illustrated in FIG. 6, it is possible to employ a recessed portion 33' which has a groove-like opening that extends along the inter-flow path opening region. In this configuration, since the inter-flow path opening region between the openings of the adjacent ink flow path sections is divided by the groove-like recessed portion 33', it is possible to still more reliably suppress the leakage of the ink between these ink flow paths. Other configurations are the same as in the embodiments described above.

The ink jet-type recording head 3 (recording head 3) that is a kind of liquid ejecting head is described as an example. However, the invention can be applied to another liquid ejecting head that employs a configuration in which a plurality of plate-like structural members are joined to each other by the adhesive and thereby the flow path of the liquid is partitioned. For example, the invention is applied to a color-material ejecting head that is used to manufacture a color filter such as a liquid crystal display, an electrode-material ejecting head that is used to produce an electrode, such as an organic electro luminescence (EL) display or a field emission display (FED), and a bio-organic material ejecting head that is used to manufacture a bio chip (biochemical component). A color-material ejecting head for the display manufacturing apparatus ejects, as a kind of liquid, a solution of each color material which is red (R), green (G), or blue (B). In addition, an electrode-material ejecting head for the electrode producing apparatus ejects a liquid-phase electrode material as a kind of liquid and a bio-organic material ejecting head for the chip manufacturing apparatus ejects a solution of a bio-organic material as a kind of liquid.

What is claimed is:

1. A liquid flow-path member comprising at least a part of a liquid flow path of a liquid ejecting head to be partitioned by joining substrates to each other by using an adhesive, wherein a first flow path section and a second flow path section, each of which is a part of the liquid flow path, are formed at an interval therebetween on at least one of the substrates, wherein the shortest distance between an opening edge of the first flow path section and an opening edge of the second flow path section in a joining surface of the one substrate is 50 μm or more, wherein a recess section is formed to be separated from the liquid flow path in a region interposed between the opening edge of the first flow path section and the opening edge of the second flow path section in the joining surface, and wherein at least one of the shortest distance between the opening edge of the first flow path section and the recess section and the shortest distance between the opening edge of the second flow path section and the recess section is 30 μm or less.

2. The liquid flow-path member according to claim 1, wherein the shortest distance between the recess section and the opening edge of the first flow path section or between the recess section and the opening edge of the second flow path section and the shortest distance between the recess sections adjacent to each other is desirably 22 μm or less.

3. The liquid flow-path member according to claim 1, wherein a plurality of recess sections are formed at an interval therebetween in a region interposed between the opening edge of the first flow path section and the opening edge of the second flow path section in the joining surface, and wherein the shortest distance between the opening edges of the recess sections adjacent to each other is 30 μm or less and desirably 22 μm or less.

4. The liquid flow-path member according to claim 1, wherein the opening edge of the first flow path section is parallel to the opening edge of the second flow path section.

5. A liquid ejecting head comprising:

the liquid flow-path member according to claim 1.

6. A liquid ejecting head comprising:

the liquid flow-path member according to claim 2.

7. A liquid ejecting head comprising:
the liquid flow-path member according to claim 3.
8. A liquid ejecting head comprising:
the liquid flow-path member according to claim 4.
9. A liquid ejecting apparatus comprising:
the liquid ejecting head according to claim 5.
10. A liquid ejecting apparatus comprising:
the liquid ejecting head according to claim 6.
11. A liquid ejecting apparatus comprising:
the liquid ejecting head according to claim 7.
12. A liquid ejecting apparatus comprising:
the liquid ejecting head according to claim 8.

* * * * *